US008720742B2

(12) United States Patent
Zhang

(10) Patent No.: US 8,720,742 B2
(45) Date of Patent: May 13, 2014

(54) SALES KIOSK

(76) Inventor: Junfang Zhang, Manhasset, NY (US)

( * ) Notice: Subject to any disclaimer, the term of this patent is extended or adjusted under 35 U.S.C. 154(b) by 236 days.

(21) Appl. No.: 13/291,050

(22) Filed: Nov. 7, 2011

(65) Prior Publication Data

US 2012/0116578 A1 May 10, 2012

Related U.S. Application Data

(60) Provisional application No. 61/411,381, filed on Nov. 8, 2010.

(51) Int. Cl.
*G07F 11/48* (2006.01)

(52) U.S. Cl.
USPC ..... 221/120; 221/121; 221/122; 221/132

(58) Field of Classification Search
USPC ..... 221/119, 120, 121, 122, 123, 126; 700/236
See application file for complete search history.

(56) References Cited

U.S. PATENT DOCUMENTS

| | | | | | |
|---|---|---|---|---|---|
| 4,560,088 | A * | 12/1985 | Tan | 221/75 |
| 5,253,782 | A * | 10/1993 | Gates et al. | 221/15 |
| 5,590,809 | A * | 1/1997 | Prescott et al. | 221/1 |
| 6,564,964 | B2 * | 5/2003 | Johnson | 221/75 |
| 6,971,543 | B2 * | 12/2005 | Halliburton et al. | 221/75 |
| 7,366,586 | B2 * | 4/2008 | Kaplan et al. | 700/241 |
| 7,673,771 | B2 * | 3/2010 | Bedore et al. | 221/123 |
| 7,860,606 | B2 * | 12/2010 | Rudy | 700/242 |
| 7,970,490 | B2 * | 6/2011 | Fellows et al. | 700/235 |
| 8,301,301 | B2 * | 10/2012 | Edwards | 700/241 |

* cited by examiner

*Primary Examiner* — Timothy Waggoner

(57) ABSTRACT

This disclosure is directed to a sales kiosk, a kiosk system and a process for dispensing or ordering one or more target products or samples of the target products. This disclosure is further directed to a kiosk system having a plurality of the sales kiosks connected via wired or wireless connections. The sales kiosks can be particularly useful for dispensing samples of sales products, such as furniture, typically not suitable to dispense at the sales location; or customized products that need to be customized. The sales kiosk can further be useful for ordering sales products. The sale kiosks can provide advantages for seeing and experiencing the sales products even the sale products cannot be directly displayed or dispensed. The kiosk can be modular and can comprise one or more modules.

19 Claims, 9 Drawing Sheets

SALES KIOSK

CROSS-REFERENCE TO RELATED APPLICATION

This application claims priority under 35 U.S.C. §119 from U.S. Provisional Application Ser. No. 61/411,381, filed on Nov. 8, 2010, the disclosures of which are incorporated by reference herein for all purposes as if fully set forth.

FIELD OF THE INVENTION

This disclosure is directed to a sales kiosk, a kiosk system and a process for dispensing or ordering one or more target products or samples of the target products. This disclosure is further directed to a kiosk system having a plurality of the sales kiosks connected via wired or wireless connections.

BACKGROUND OF THE INVENTION

Marking of products can commonly involve displaying the products for customers to see and experience before purchasing. Some products can be difficult to display or dispense at sales locations, such as large furniture; or have large number of selections making it impossible to display at one physical location, such as large numbers of fabrics combinations for fashion design.

Conventional solutions for dealing with such difficulties can involve the use of paper or digital catalogs.

Needs exist for improved process and system for display and dispense one or more products.

SUMMARY OF INVENTION

The present invention is directed to a kiosk system comprising one or more kiosks for dispensing one or more target products, each of said kiosks comprising:

A1) a kiosk housing;

A2) a user interface system comprising one or more input devices, one or more display devices, or a combination thereof; and A3) one or more dispensing systems housed in said kiosk housing, each of said dispensing systems comprises one or more storage devices for storing a plurality of stored products, a dispensing control system for selecting said target products from said stored products and dispensing said target products based on a dispensing signal.

The present invention is also directed to a process for dispensing one or more target products, said process comprising the steps of:

P1) providing at least one kiosk comprising a user interface system comprising one or more input devices, one or more display devices, or a combination thereof; and one or more dispensing systems each comprising one or more storage devices for storing a plurality of stored products and a dispensing control system;

P2) obtaining a request input from said one or more input devices;

P3) displaying product display data said on one or more display devices, said product display data comprise images of one or more of sales products, motion images of one or more of said sales products, descriptions of one or more of said sales products, identifiers of one or more of said sales products, or a combination thereof, based on said request input or a predetermined product display scheme;

P4) optionally, receiving one or more modified request inputs and repeating the steps P2)-P4);

P5) obtaining a selection input from said one or more input devices to select one or more target products from said one or more sales products; and P6) generating a product availability data based on said selection input and availability of one or more of said stored products associated to said one or more target products, said availability data comprise product location data and product quantity data of said plurality of stored products;

wherein said stored products comprise one or more said sales products, one or more parts of said sales products, one or more specimens of said sales products, one or more simulated specimens of said sales products, one or more image products of said sales products, one or more digital data products of said sales products, or a combination thereof.

DETAILED DESCRIPTION OF THE INVENTION

Figure 1A:
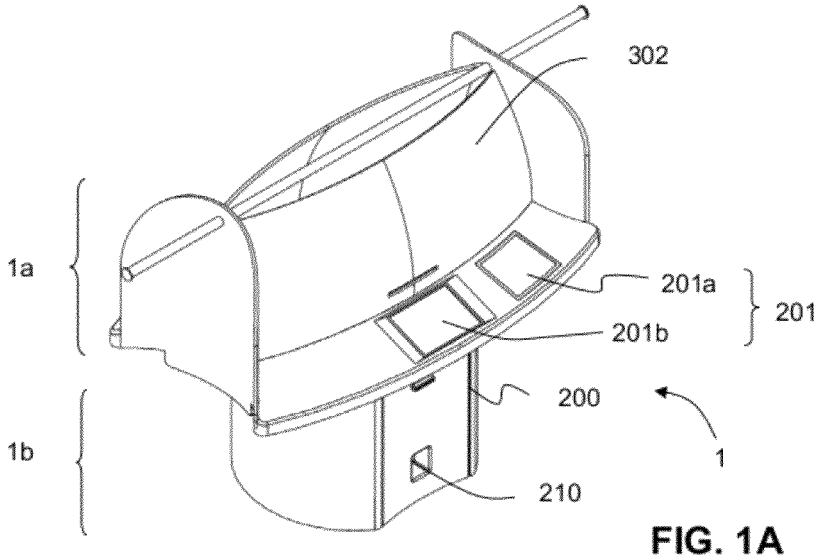
FIG. 1 shows schematic representations of examples of the kiosk: (A) an oblique view of the kiosk; (B) a frontal view of the kiosk; and (C) a cross-sectional view of the kiosk.

The features and advantages of the present invention will be more readily understood, by those of ordinary skill in the art, from reading the following detailed description. It is to be appreciated that certain features of the invention, which are, for clarity, described above and below in the context of separate embodiments, may also be provided in combination in a single embodiment. Conversely, various features of the invention that are, for brevity, described in the context of a single embodiment, may also be provided separately or in any sub-combination. In addition, references in the singular may also include the plural (for example, "a" and "an" may refer to one, or one or more) unless the context specifically states otherwise.

The use of numerical values in the various ranges specified in this application, unless expressly indicated otherwise, are stated as approximations as though the minimum and maximum values within the stated ranges were both proceeded by the word "about." In this manner, slight variations above and below the stated ranges can be used to achieve substantially the same results as values within the ranges. Also, the disclosure of these ranges is intended as a continuous range including every value between the minimum and maximum values.

This disclosure is directed to a kiosk system comprising one or more kiosks for dispensing one or more target products. Each of the kiosks can comprise:

A1) a kiosk housing (200);

A2) a user interface system (201) comprising one or more input devices, one or more display devices, or a combination thereof; and A3) one or more dispensing systems (203) housed in the kiosk housing, each of the dispensing systems comprises one or more storage devices for storing a plurality of stored products, a dispensing control system for selecting the target products from the stored products and dispensing the target products based on a dispensing signal.

The kiosk housing can be made from metal, wood, plastic, composite materials, or a combination thereof. The kiosk housing can further be coated with one or more coating layers. The kiosk housing can enclose the dispensing systems.

The user interface can comprise display/input combination device, such as a touch screen, separated input devices, separated display devices, or a combination thereof. The input devices can be any devices that can enter input into the kiosks. Digital input devices can be suitable and can be preferred. Examples of digital input devices can include, such as a keyboard, a scanner, a barcode reader, an RFID reader, a touch screen, a smart phone that can receive digital input signals, a graphic or hand-writing recognition device that convert graphics or hand-writing patterns into digital signals, or a combination thereof. The display devices can be a message board, a post board for posting flyers or samples, a rack or shelf, a digital display device such as a touch screen, a monitor, a projector, a TV, a smart phone that can receive signals to display images or texts on its screen, or a combination thereof.

The dispensing control system of each of the kiosks can comprise:

B1) at least one positioning drive device (208) to position a target storage device into a dispensing position based on the dispensing signal, the target storage device comprises at least one of the target products; and B2) at least one dispensing drive device (209) comprising a dispensing drive coupling (219) for coupling to one of the storage devices to dispense the at least one of the target products based on the dispensing signal.

The positioning drive device (208) can be a motion providing device that can move the position drive coupling (207) to position one or more storage devices to a desired position, such as the dispensing position. Examples of the positioning drive device can include one or more motors. The position drive coupling can comprise one or more belts, gears, shafts, or a combination thereof.

The storage devices can be movably positioned over a storage base (213) coupled to the positioning drive device. Each of the storage devices (204) can comprises a linear dispensing-storage drive (218) for receiving one or more dispensing packages (217). The linear dispensing-storage drive (218) can have a dispensing coupling (216) at one end and a releasing end (212) at the other end distal to the dispensing coupling (216). The storage device can have a storage dispense opening (220) near the releasing end of the linear dispensing-storage drive for releasing the dispensing packages. The dispensing coupling (216) can be configured to be coupled to said dispensing drive coupling (219) for dispensing one of said dispensing packages from said releasing end (212) based on the dispensing signal at said dispensing position and can be configured to be un-coupled to the dispensing drive coupling when said storage device is not at said dispensing position.

Figure 1B:
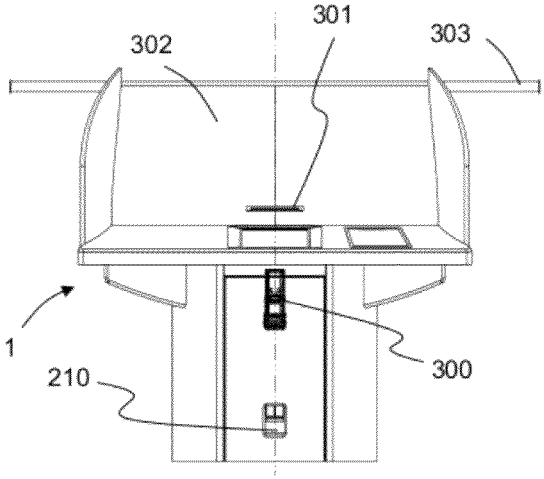
Figure 1C:
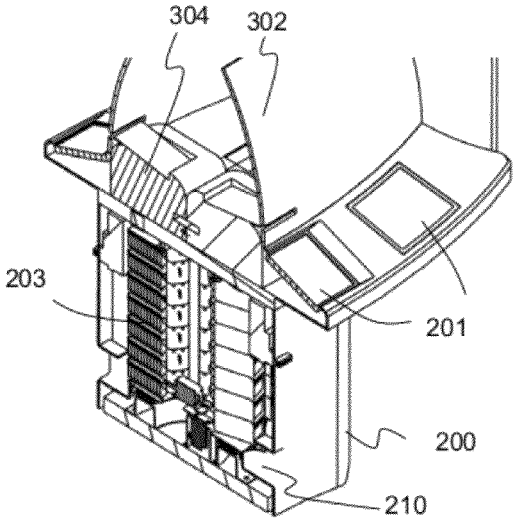

FIG. 1 shows schematic representations of an example of the kiosk (1) with an oblique view of the kiosk (FIG. 1A); a frontal view of the kiosk (FIG. 1B); and a cross-sectional view of the kiosk (FIG. 1C). The kiosk can have one or more user interface devices (201), such as a touch screen, a scanner, fax, or a keyboard. The user interface devices (201) can comprise one or more modules, such as one module (201*a*) that can comprise a touch screen and one or more subsequent modules (201*b*) that can comprise a scanner or a fax machine. The kiosk can further comprise one or more print dispensing opening (301), one or more printers (304), dispensing opening (210), and one or more subsequent display devices (302). The kiosk can further comprise a display rod (303) for hanging or otherwise displaying samples.

Figure 2A:
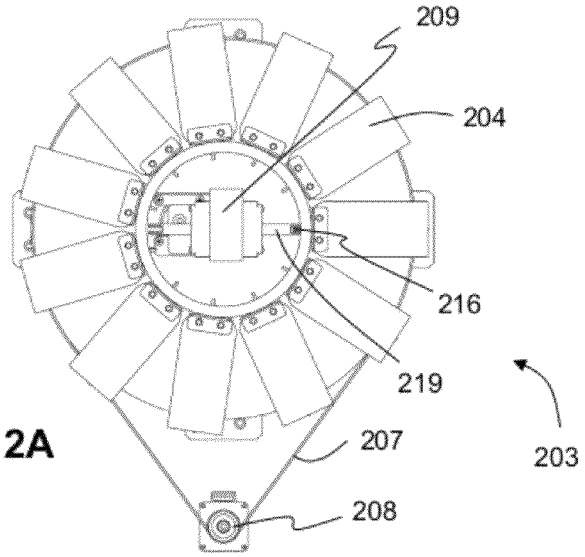
FIG. 2 shows schematic representations of examples of a dispensing system: (A) a top-down view of the dispensing system; (B) a perspective view of one example of the dispensing system; (C) a perspective view of another example of the dispensing system; and examples of dispensing devices (D) and (E).
Figure 2B:
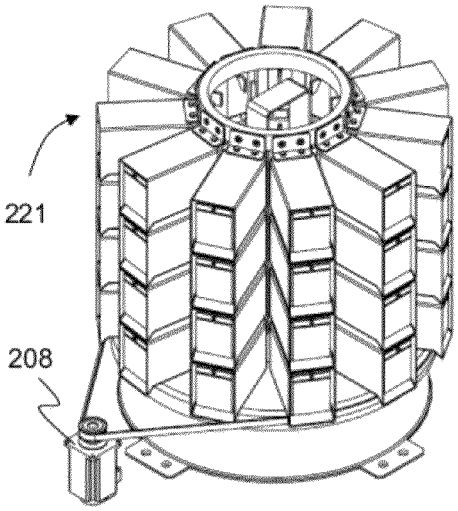
Figure 2C:
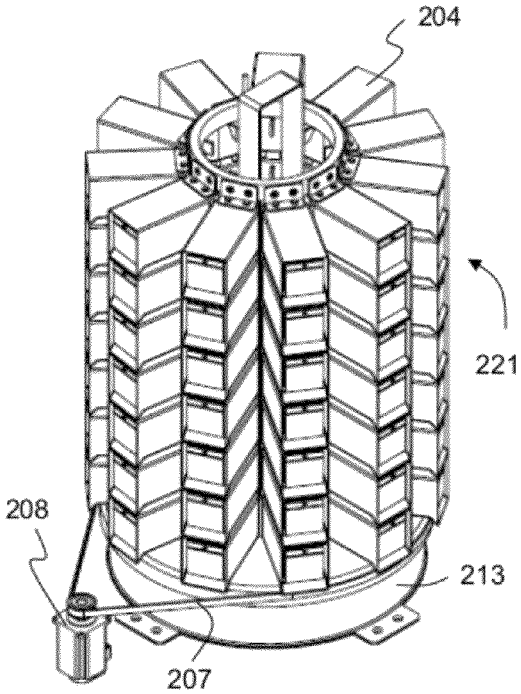

A number of the storage devices can be arranged into a storage stack that can comprise in a range of from 1 to 20 storage devices in one example, 1 to 15 storage devices in another example, 1 to 10 storage devices in yet another example, and 1 to 5 storage devices in yet another example. A number of the storage stacks, such as in a range of from 3 to 51 in one example, 3 to 41 in another example, 3 to 31 in yet another example, 3 to 21 in yet another example, and 3 to 11 in yet another example, can be arranged in a circular pattern on the storage base (FIGS. 2A, 2B, and 2C) to form a circular storage tower (221) (FIGS. 2B and 2C). It is preferred to have an old number of storage stacks arranged on the storage base so that the dispensing drive device (209) can only be coupled to one storage device at any given position to avoid simultaneous coupling with two storage devices at same time (FIG. 2A). This can prevent mis-dispensing products. The storage devices can be configured to be moved on the storage base by the dispensing drive coupling (207), such as a belt, coupled to the positioning drive device (208), such as a motor. Once the motor rotates, the storage devices can be moved to position a particular storage device to the dispensing position. Each storage stack can have a horizontal positioning ID for proper positioning of the storage stack to the dispensing position. The positioning drive coupling (207) can have one or more horizontal positioning engagement points for proper positioning of the storage stack to the dispensing position. A combination of the horizontal positioning ID and the horizontal positioning engagement points can also be suitable.

Figure 2D:
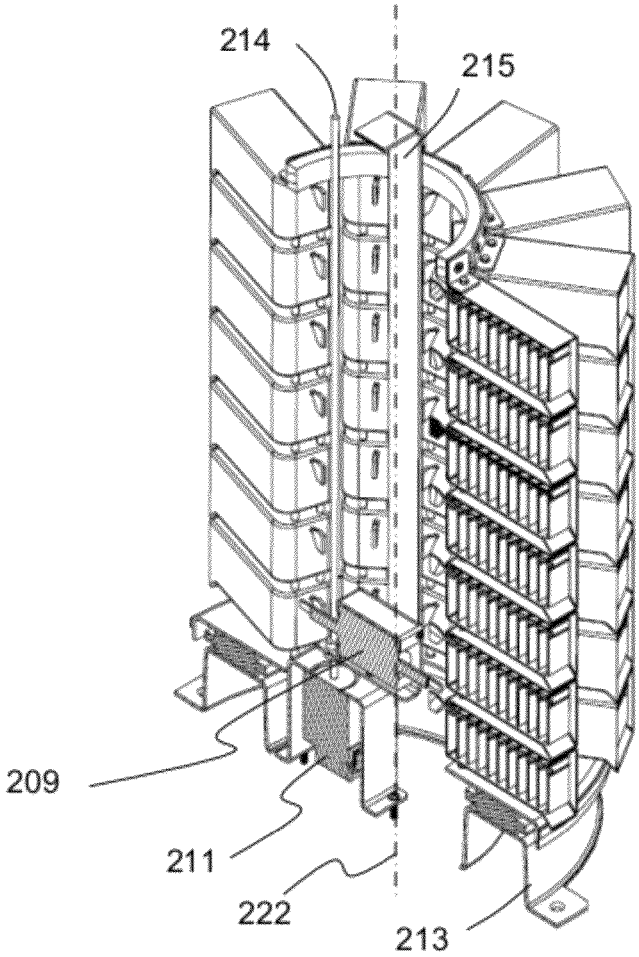
Figure 2E:
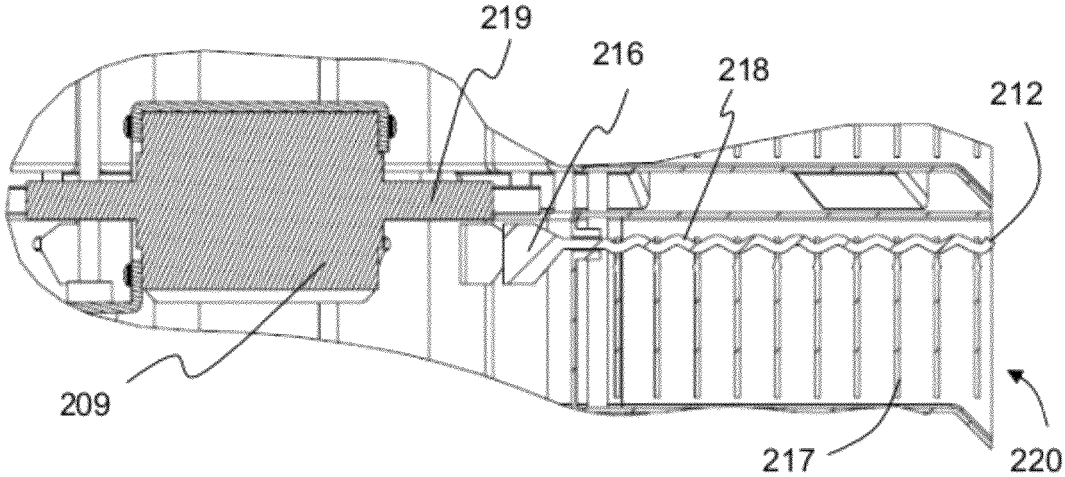
Figure 3A:
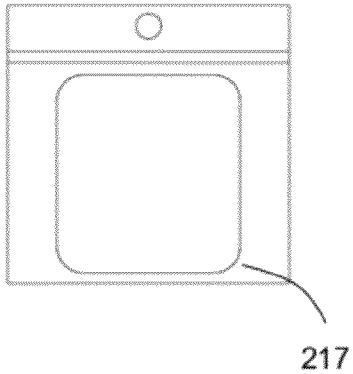
FIG. 3 shows schematic representations of examples of target package: (A) a frontal view of a target package and (B) a perspective view of the target package.
Figure 3B:
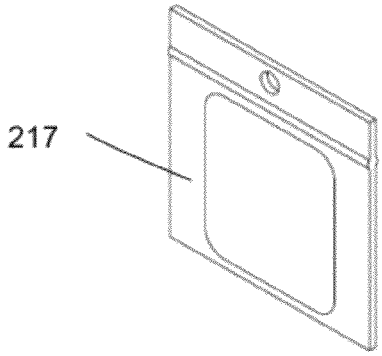

The dispensing drive device (209) can be positioned in a center space of the circular storage tower (221) movable alone a center track (215). The dispensing drive device (209) can be moved by a driving rod (214) that is driven by a rod motor (211) (FIG. 2D). The center track (215) and the driving rod (214) can be parallel to the rotational axis (222) of the circular storage tower (221). Each of the storage devices can have a vertical positioning ID. The center track (215), the driving rod (214), or a combination thereof, can have one or more vertical positioning engagement points. The dispensing drive device (209) can be positioned to a particular storage device based on the vertical positioning ID, the vertical positioning engagement points, or a combination thereof. Once positioned, the dispensing drive coupling (219) can be coupled to the dispensing coupling (216) to dispense the target product from the selected storage device. In one example, the dispensing drive coupling (219) can rotate causing the coupled dispensing coupling (216) and the linear dispensing-storage drive (218) to rotate. The dispensing packages (217) can be configured on said linear dispensing-storage drive (218) so that each full turn rotation can release one dispensing package from the storage dispense opening (220) (FIG. 2E). The released dispensing package can slide to the dispensing opening (210) (FIG. 1). Examples of the dispensing packages (217) can include bags, such as those shown in FIGS. 3A and 3B, or cans, boxes, or a combination thereof.

The storage stacks can also be arranged in linear fashion such as in rows or a grid.

The combination of the horizontal IDs, horizontal positioning engagement points, vertical IDs, and vertical positioning engagement points can be suitable for positioning and dispensing the target products.

The kiosk system can further comprise a database comprising product data, the product data comprise interrelated images of one or more sales products, motion images of the sale products, text descriptions of the sales products, identifiers of the sales products, or a combination thereof, the database is functionally coupled to each of the kiosks. The database can be installed in a computing device located within the kiosk housing, installed in a remote computing device and accessed from the kiosk, or a combination thereof. When the database is present, it is preferred to have a computing device for accessing the database. The computing device can be located within the kiosk or located in a remote location, however, functionally coupled to the one or more display devices.

The stored products can comprise one or more the sales products, one or more parts of the sales products, one or more specimens of the sales products, one or more simulated specimens of the sales products, one or more image products of the sales products, one or more digital data products of the sales products, or a combination thereof. For sales products in small sizes that are suitable for storing in the storage devices, the actual sale products can be stored and dispensing from the kiosk. One or more specimens of the sale products, such as small pieces of samples of large rolls of fabrics, can be stored as the stored products. The simulated specimens can include, for example, a small scale model of a vehicle, a part of furniture, or a part of a picture frame. The image products of the sales products can include, for example, one or more photos of a house. The digital data products of the sales products can include, for example, a music CD or DVD, a movie DVD, or a digital book flash memory device.

Each of the kiosks can further comprise:

A4) a payment processing device (300) for receiving payments and generating the dispensing signal; the dispensing signal is generated based on a selection input for selecting the one or more target products and a payment approval signal.

The payment processing device (300) (FIG. 1B) can be a coin collector, a money receiver, a coupon reader, a credit or debit card processor, or a combination thereof. The payment processing device can be connected via wired connections, wireless connections, or a combination thereof to a computing device or a credit card processing center for validating payments.

The selection input can be based on images of the sales products, motion images of the sales products, text descriptions of the sales products, identifiers of the sales products, or a combination thereof, displayed on the one or more display devices as display images. The display images can be displayed on one or more digital display devices, such as a touch screen, a monitor, a projector or a combination thereof. The display images can comprise display color values comprising R,G,B color values based on the images of the sales products, motion images of the sales products, text descriptions of the sales products, identifiers of the sales products, or a combination thereof. The R,G,B color values based on R,G,B color model that is an additive color model in which red, green, and blue light is added together in various ways to reproduce a broad array of colors.

Each of the kiosks can further comprise:

A5) a computing device coupled to the one or more input devices and the one or more display devices, the computing device is functionally coupled to a computing program product comprising computing program codes for:

C1) receiving a request input from the one or more input devices;

C2) displaying product display data on the one or more display devices, the product display data are retrieved from the database and comprise images of one or more of the sales products, motion images of one or more of the sales products, descriptions of one or more of the sales products, identifiers of one or more of the sales products, or a combination thereof, based on the request input or a predetermined product display scheme;

C3) optionally, receiving one or more modified request inputs and repeating the steps C1)-C3); and C4) receiving the selection input from the one or more input devices selecting the one or more target products from the sales products.

The computing program product can further comprise computing program codes for:

C5) generating a product availability data based on the selection input and availability of one or more of the stored products associated to the one or more target products, the availability data comprise product location data and product quantity data of the plurality of stored products;

C6) displaying the product availability data on the display devices; and

C7) generating an order data for ordering the at least one of the target products if at least one of the target products is not available from the kiosk system, the order data comprise a target identifier of the at least one of the target products based on an order selection.

The computing program product can further comprise computing program codes for:

C8) generating a payment request based on the selection input and the payment schedule;

C9) displaying the payment request on the one or more display devices;

C10) generating the payment approval signal after receiving and verifying payments according to the payment request;

C11) generating the dispensing signal; and

C12) outputting the dispensing signal to the one or more dispensing systems where the one or more target products are stored to dispense the one or more target products.

Any of computing devices known to or developed by those skilled in the art can be suitable. The computing devices can include a stand alone computer, a computing processor, a computing chip, a remote computer, or a combination thereof. The computing program product can installed on the computing device or installed on a remote host computer and accessed from the computing device. In one example, the input touch screen can comprise a computing chip functions as a computing device. In another example, one of the display devices can comprise a computing processor functions as a computing device. In yet another example, the kiosk can comprise a laptop computer.

As mention above, each of the kiosk can further comprise a dispensing opening (210) positioned on the kiosk housing (200) for dispensing the target products, one or more subsequent display devices for displaying product information based on predetermined schedule, the selection input, history of selection inputs, a display input, or a combination thereof.

Figure 4:
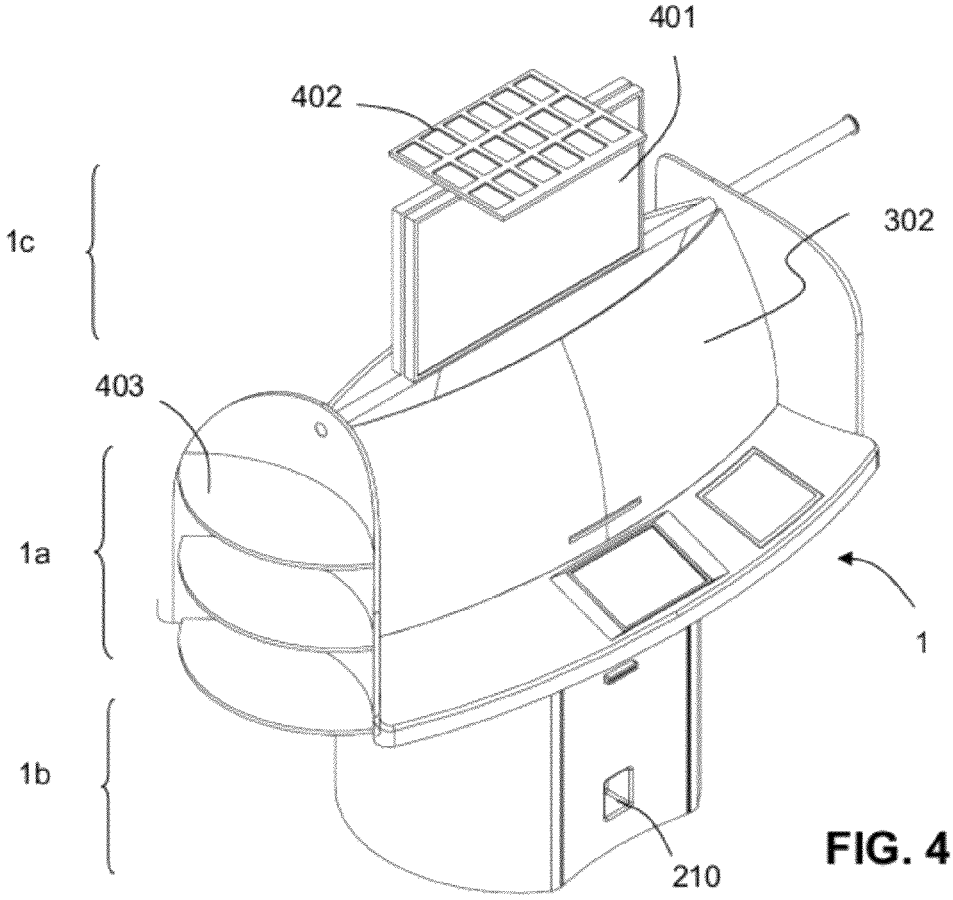
FIG. 4 shows a schematic representation of another example of the kiosk.

Examples of the subsequent display devices can include first vertical display areas (302) (FIG. 1) and a second vertical display area (401) in another example of the kiosk (FIG. 4). The subsequent display devices can also comprise digital display devices. In one example, when a request input is for a dinning table, one or more images of dinning tables in different style or materials can be displayed on the one or more display devices. At the same time, one or more images of dinning room chairs, service tables, cabinets, dinning room accessories, or a combination thereof, can be displayed on one or more of the subsequent display devices.

In the kiosk system, at least one of the kiosks can further comprise one or more physical display structures, one or more testing spaces, or a combination thereof, for displaying or testing one or more of the sales products, one or more specimens of the sales products, one or more simulated specimens of the sales products, or a combination thereof. Examples can include one or more shelves (403) (FIG. 4). In one example, one or more actual sales products can be displayed on one or more of the shelves.

The kiosk can further comprise one or more solar panels (402) (FIG. 4). The solar panels can be use for providing energy for powering the kiosk and can also function as a roof for protecting the kiosk. The solar panels can provide mobility to the kiosk, especially providing advantages for positioning the kiosk in areas where electric power supply can be limited.

Figure 5A:
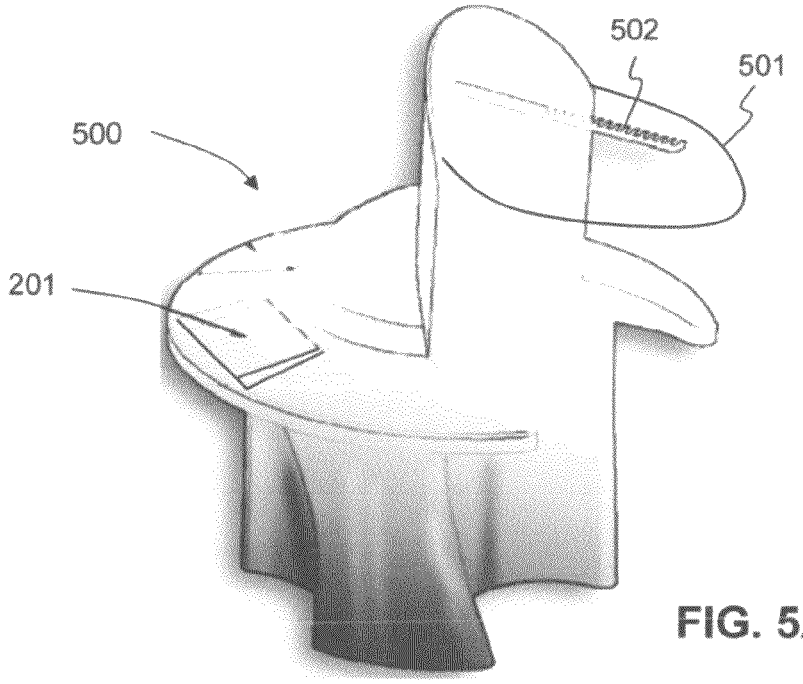
FIG. 5 shows schematic representations of yet another example of the kiosk: (A) a realistic perspective view; and (B) a top-down view.
Figure 5B:
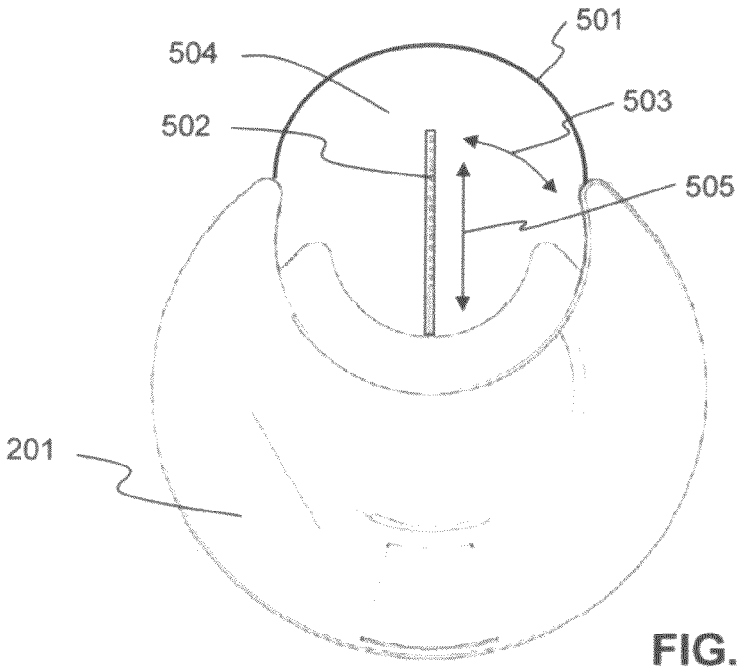

FIG. 5 shows another example of the kiosk (500) that comprises a testing area (504) that can be closed by a slidable curtain hanging on a curtain rack (501) (FIG. 5A) for testing products, such as clothing. The kiosk can further comprise a product hanger (502) that can be swung in the swing directions (503), retracted in the retract directions (505), or folded for easy access to the testing space (FIG. 5B).

Figure 6:
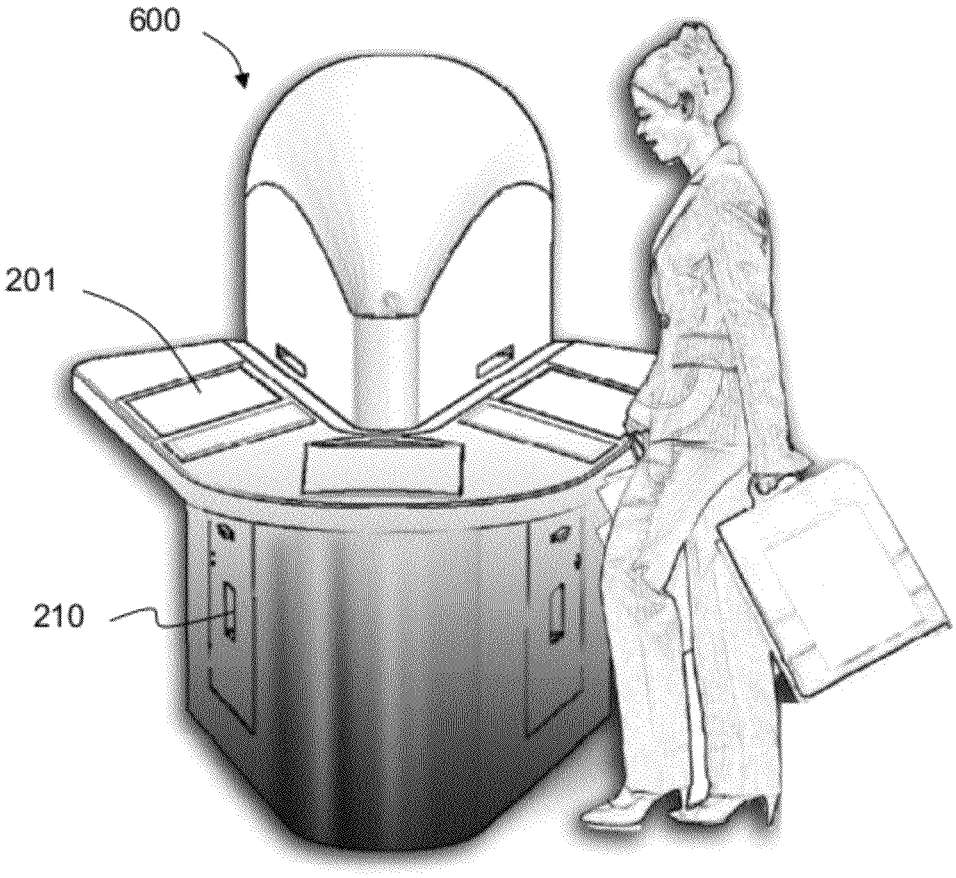
FIG. 6 shows a schematic representation of yet another example of the kiosk.

FIG. 6 shows yet another example of the kiosk (600).

The kiosk can also comprise one or more designing spaces for designing a new product or modifying one of the sales products.

At least one of the kiosks can comprise one or more functionally coupled modules. The kiosk can comprise a display module (1*a*) comprising one or more display devices and shelves, a dispensing module (1*b*) comprising the storage devices and dispense devices, a user interface module comprising the user interface (201), or a combination thereof (FIG. 1 and FIG. 4). The kiosk can further comprise one or more subsequent modules such as a solar module (1*c*) comprising the solar panels (402), office module as described hereafter, and other modules. The modules can be coupled via module couplings such as wires, electrical and mechanical couplings. The modular design can provide easy upgrade or improvement of the kiosks.

In the kiosk system of this disclosure, at least one of the kiosks can comprise a security system. The security system can comprise a security connection to a remote security control device via wired connections, wireless connections, or a combination thereof, for monitoring, controlling and protecting the kiosk. The kiosk housing can be made from metal to increased security. The security system can comprise a locking system, such as a physical lock, a physical locking system that can be opened with a set of codes, a physical digital locking system that can be opened based on a digital signal received locally or remotely, or a combination thereof. The security system can be configured to generate an alarm to inform the owner of the kiosk system, security services responsible for the security of the kiosk system, local police department, or a combination thereof.

Figure 7A:
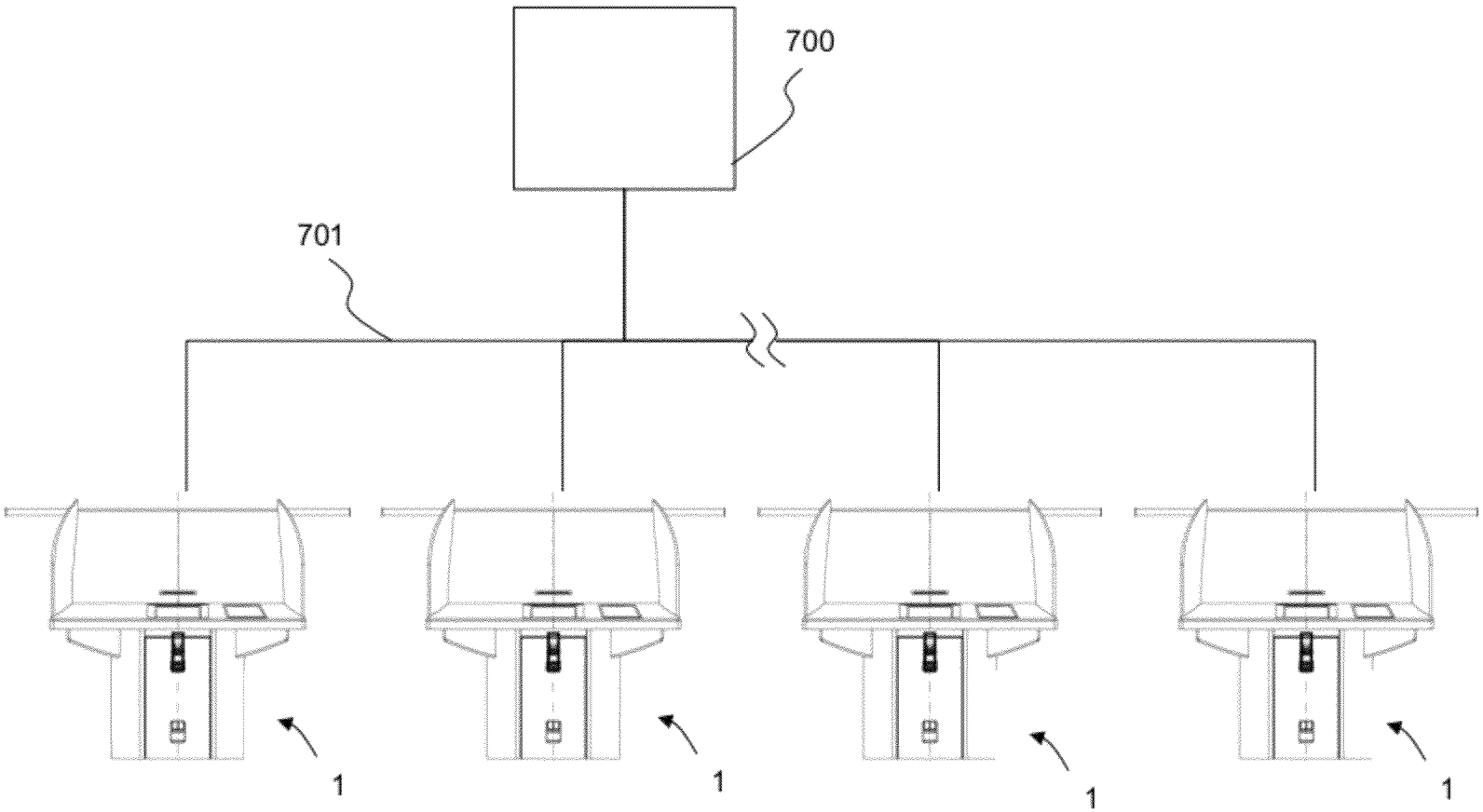
FIG. 7 shows schematic representations of examples of networks of the kiosks: (A) a parallel configuration; and (B) an interrelated network configuration.
Figure 7B:
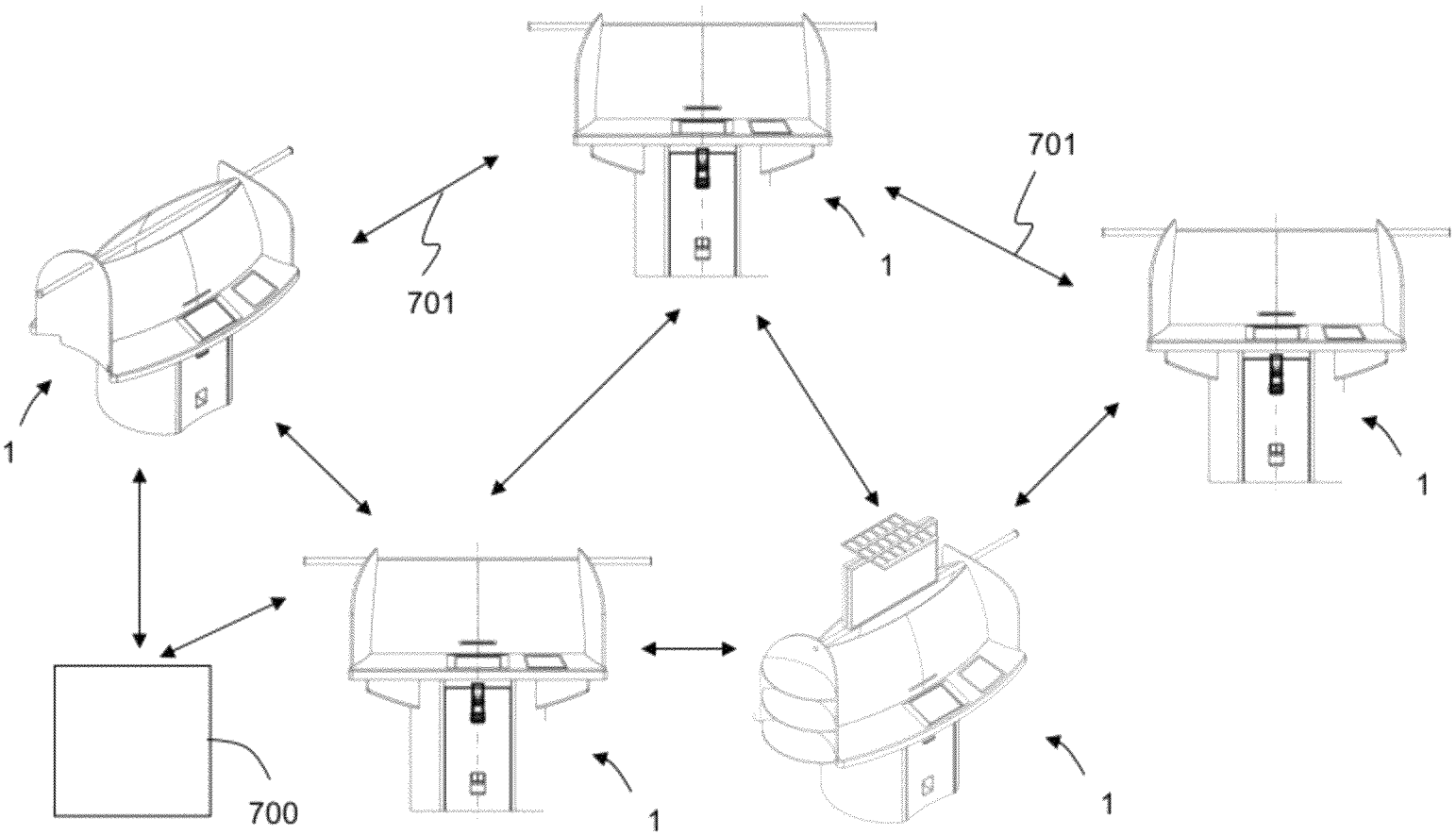

The kiosk system can be configured in a network, such as a parallel configuration (FIG. 7A); an interrelated network configuration (FIG. 7B), or a combination thereof. The kiosk system can further comprise one or more server computing devices (700) functionally coupled to each of the kiosks via one or more network connections (701) selected from wired connections, wireless connections, or a combination thereof. The kiosk system can comprise two or more the kiosks connected via wired connections, wireless connection, or a combination thereof.

This disclosure is further directed to a process for dispensing one or more target products. The process can comprise the steps of:

P1) providing at least one kiosk comprising a user interface system comprising one or more input devices, one or more display devices, or a combination thereof; and one or more dispensing systems each comprising one or more storage devices for storing a plurality of stored products and a dispensing control system;

P2) obtaining a request input from the one or more input devices;

P3) displaying product display data the on one or more display devices, the product display data comprise images of one or more of sales products, motion images of one or more of the sales products, descriptions of one or more of the sales products, identifiers of one or more of the sales products, or a combination thereof, based on the request input or a predetermined product display scheme;

P4) optionally, receiving one or more modified request inputs and repeating the steps P2)-P4);

P5) obtaining a selection input from said one or more input devices to select one or more target products or one or more selected sales products; and P6) generating a product availability data based on said selection input and availability of one or more of said stored products associated to said one or more target products, and availability of said selected sales products, said availability data comprise product location data and product quantity data of said plurality of stored products, said selected sales products, or a combination thereof;

wherein said stored products comprise one or more said sales products, one or more parts of said sales products, one or more specimens of said sales products, one or more simulated specimens of said sales products, one or more image products of said sales products, one or more digital data products of said sales products, or a combination thereof.

The process can further comprise the steps of:

P7) generating a payment request based on the selection input and a payment schedule;

P8) displaying the payment request on the one or more display devices;

P9) generating a payment approval signal after receiving and verifying payments based on the payment request;

P10) generating a dispensing signal; and

P11) dispensing based on the dispensing signal the one or more target products from the one or more dispensing systems according to the product availability data.

The process can further comprise the steps of:

P12) displaying the product availability data on the display devices, particularly if at least one of the target products is not available from the one or more dispensing systems; and P13) generating an order data for ordering said at least one of said target products or said selected sales products, said order data comprise a target identifier of at least one of said target products or sale product identifiers of said selected sales products based on an order selection.

The kiosk system of this disclosure can be an automated sales kiosk for placement in a public space such as a shopping mall or store. As mentioned above, the kiosk can combine electronic or digital displays, inputs, and outputs, with physical samples of the goods, or of the materials, such as the sale products, of which the goods may be ordered by the customer.

If samples of a particular material are out of stock at a given kiosk, the kiosk can advise the customer where the nearest kiosk is in the kiosk system that has that sample, in stock. In the case of a fabric, the kiosk can advise the customer which fabric, in stock at the present kiosk, is of a similar material and feel, offer the customer that sample, and can print on paper a color image of the pattern for later comparison by the customer with other items to be coordinated.

The process and the kiosk system of the disclosure can be useful for ordering large size products, such as furniture, or customized products, such as paintings.

Further examples and the use of the kiosk or the system can be disclosed herein.

Figure 8A:
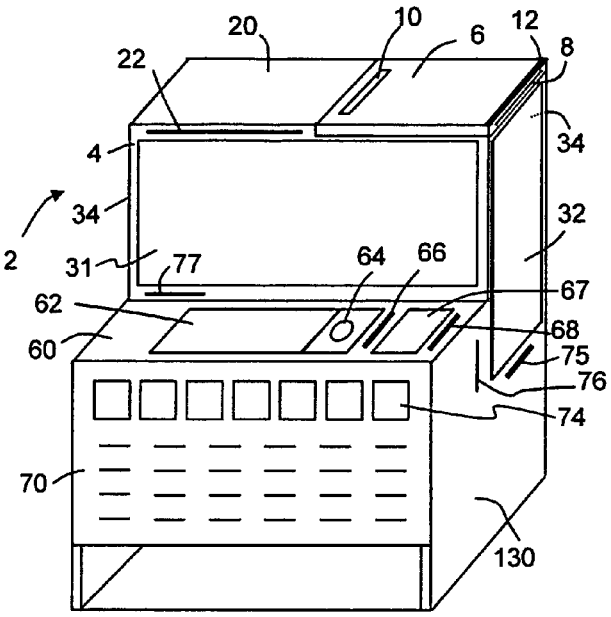
FIG. 8 shows schematic representations of yet another example of the kiosk: (A) a perspective view; (B) a top-down view; (C) a view of the back side of the kiosk; and (D) a realistic display on a display device of the kiosk.
Figure 8B:
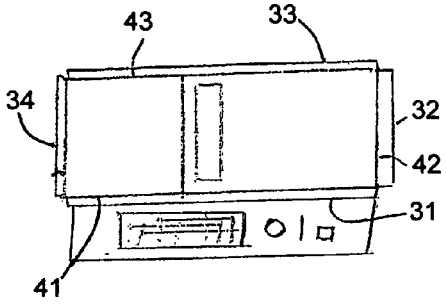
Figure 8C:
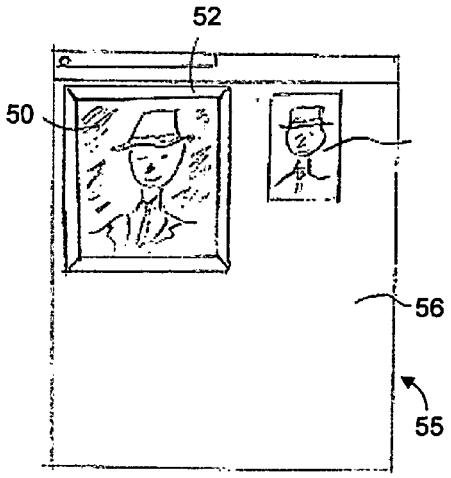

FIG. 8 shows further examples of the kiosks with an oblique view (FIG. 8A) and a top plan view thereof (FIG. 8B). A back elevation of a painting kiosk for painting products is shown in FIG. 8C. A back elevation of a window kiosk for window treatment is shown in FIG. 8D wherein various window treatment products can be displayed on a simulated window.

The kiosk 2 (2) (FIGS 8A and 8B) can comprise an office module (4) at its top. A scanner input (6) can be located on its top surface. This scanner serves as an image input for scanner, outgoing fax, and copier. It can comprise a feeder input (8), a scanner output (10), and hinge (12), so that it can be operated as a flat-bed scanner. The office module can include a printer (20), for printing: incoming faxes, copies, emails, ordering information, order confirmations, and receipts. The printer can also alternatively be positioned anywhere on the kiosk, where it can be logical for outputting copies, faxes, emails, receipts, and order confirmations. An output slot (22) can deliver printed sheets to the user.

For a price, this kiosk can be used by a customer as an e-mail computer; or it can be used as an online general service computer. In one example, the price can be a quarter ($0.25 US) per 15 minutes, paid for by a coin or coins, currency, or by a credit card. This price can vary, depending on the cost of renting or buying the kiosk's floor space, the policy of the space provider, traffic, supply and demand, and its value as a generator of customer traffic. It can be offered for free to bring customers into a store or mall. The kiosk can have eye-level surfaces display areas (31-34) (FIG. 8A) on its 4 sides (41-44) (FIG. 8B). The display areas can have LED or LCD screens having screen sizes ranging from 17" to 21".

The kiosk 2 (2) can comprise a keyboard surface (60) comprising a keyboard (62), a cursor control (64), a credit card slot (66), a currency slot (67), and a coin input, such as a coin slot (68). The input device or devices, can also be a touch screen, mounted as one or more of the active display screens, such as a frontal screen (31).

Extending vertically downward from the front of the keyboard surface (60) can be a front surface (70). The front surface can mount a plurality of dispensers of samples (74), such as framing materials for the paintings.

In response to any user input, or even to sensing the presence of a user by infra-red sensing, the frontal screen (31) can invite the user to browse or purchase products from the kiosk.

In another example, a painting kiosk (55) can be used for dispensing custom made oil paintings. The painting kiosk can display an actual oil painting (50) on one area of its sides (56) in a painting frame (52). Next to the oil painting (50) can be a photograph (54). This system can be particularly suited for portraits. Other types of paintings such as landscape, still life, or nature scenes can also be suitable. Water colors and other art mediums may also be displayed and dispensed for sale this way.

This area of the sides of the kiosk (56) can also serve as advertisement area for an oil painting, which can be ordered. A user can also scan a photos into the kiosk so a oil painting can be ordered to be painted by a remotely located artist. Other side areas of the kiosk can have digital display screens for displaying the same or different product information or images. The digital display screens can also depict different frame styles and backgrounds, in an ever-changing slide show, the presentation of which can be paused and reviewed or forwarded based on inputs from the user.

The user can be presented with choices, such as 1) using the office module or 2) buying a painting.

If the user chooses to use the office module, the user is prompted to insert $0.50 in coins into the coin slot (68), or a credit card/debit card into a credit card slot (66), to give the user operational access to the office module.

The user can scan and fax and copy documents, from the scanner (6) on the top surface, for rates set by the kiosk owner. The user can also email the documents as attachments, or simply read or write email using the kiosk, or print incoming attachments individually or in quantity by printer (20).

If the user chooses to buy a painting, the customer can follow prompts to do so. The user can order a hand painted oil painting such as the oil painting (50). The system can also prompt the user to scan-in an original photograph which he wants to be painted from the scanner (6). The frontal screen (31) can be used to display choices of background and colors. The kiosk can also display a proposed portrait with the color choices made by the user, against the color of the wall the user intends to mount it on. The kiosk can ask the user to choose known colors from the maker of the paint that his wall was painted with, if he knows that information.

The user can adjust the wall color using his memory and a virtual color palate presented on the frontal screen (31). If the user wants to match frame material to his home, he can insert a coin in slot (68) to pay for a sample of frame material to take home, from the samples (74) of frame material mounted on frontal kiosk surface (70). The kiosk can then prompt the user to input his customer information and delivery information, and thereby commissions creation of an original portrait or painting by an oil painting artist. The user can make immediate payment by debit or credit card to finalize the sale.

In an alternative, the customer can take the sample home and email himself the incomplete order information with links to a site that will complete his order, on-line, after he compares everything to his home decor.

Clothing Sales Embodiment:

This embodiment can have all four display screens (31-34) shown in FIGS. 8A and 8B. The user can also order custom clothing by following prompts from the frontal screen (31), inputting style and size information, and selecting samples (74), such as fabric sample, from the frontal kiosk surface (70). Samples (74), such as fabrics in this embodiment, can be purchased for a coin, and brought home to match other accessories. For final checkout, credit card information can be taken as before.

On each side 41-44, advertisements for garments can be displayed.

Household Products:

The user can also order products for the home, such as window treatments or slipcovers by inputting measurements, and selecting a fabric as before. The user can possibly bring fabric samples home to match, making a final fabric & options selection, and inputting charge information.

Figure 8D:
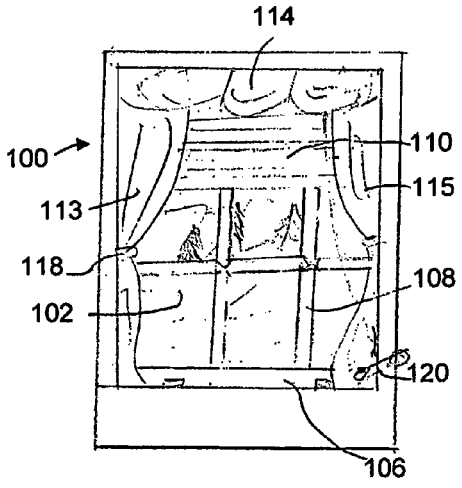

Window Treatment:

FIG. 8D shows an embodiment for selling a window treatment (100). A window view picture (102) of a scene can be displayed using a photo print or a digital display device. The window view picture (102) can be located behind an actual window, a window frame (106) and mullions (108), blinds (110) and curtains (113-115), ties (118), and functioning hardware (120), so that a user can see, feel, and operate the window treatment items she might order. A fabric sample dispenser can be located at frontal surface (70) as shown in FIG. 8A, similarly provides samples (74) such as curtain materials for the user to bring home and match to her decor. The window view picture (102) can be passive, or an active digital display that can suggest, point to, virtually assemble, and order or wish-list, the various items in the window display.

The various embodiments can have four modules:

1. An office module 4 for scan, fax and copier. In the portrait embodiment a picture to be painted can be scanned into the scanner (6), for use by the artist.

2. An advertising module at the outer surfaces that can comprise the display advertising surfaces (31-34).

3. An online computer module, within, directs images to the advertising modules, and allows the user to order or wish-list products.

4. A sample box (130) presents samples of material from the frontal surface 70, or perhaps from all four sides, for showing the quality of material, true color, pattern, finish and hand. The term "hand" as used herein means the way the fabric feels when it is touched. Terms like softness, crispness, dryness, and silkiness can be some of the terms that describe the hand of a fabric. A good hand refers to shape retention without stiffness.

This kiosk can also dispense samples (74) for the user to take home and compare to her decor. Additional sample dispensers (75-77) can be located near the display screens (31-34), to dispense samples, at the point of depiction, of the fabric or of the surface material, shown on the digital active display screen or on a passive display.

The modular design can enable easy upgrades and cost control.

Examples of the sales products can include: home textile products such as fabric samples for bedding, window treatment, tablecloth and linens; furniture, such as samples for upholstery and wood surfaces; kitchen cabinet & closets, such as samples of surface materials; bath furniture, such as actual fixtures mounted on a passive surface such as the sides, or samples of surface materials, provided to show and allow feeling of the actual material, thus showing quality, color, pattern, and finish; shoes, such as samples of actual shoe surface materials, showing quality, color, pattern and hand; garments, such as fabric samples; luggage, accessories, bags, and purses, such as samples of surface material and color samples, or samples of actual materials used, in belts, scarfs, hats, socks, trims, luggage surface material, to show true quality, color, pattern, finish, and hand; home decoration painting products, such as color swatches; paintings, such as frame samples; window treatments, such as fabric samples; television sets, such as branded display screens (31-34) for branded TV sets, such as a Sony 21" TV, cables, connectors, and related mounting products; and packaged non frozen food, such as cookies and individually wrapped samples of the food, for immediate tasting by the customer.

The kiosk can also dispense full packages to the customer, or take on-line orders for delivery by mail.

The kiosk can allow user to design her own style of custom made products, by picking her own material from aforementioned material module; and picking a style from a linked website.

The customer can make a truly original product by designing her own style of item, drawing up plans, and scanning her plan and emailing it, or faxing her plan to a related customer service department, for evaluation and pricing for custom fabrication. The kiosk can be used to contact the customer service department for service or repair of the product. In response to a customer selecting a menu choice to contact a customer service department, a menu on the kiosk can prompt the customer to scan her item's label, barcode, or the actual item, onto the scanner surface, and thereby transmit the model or style to the related customer service department. Alternatively, pictures can be presented to the user that can allow the user to identify the product to the customer service.

In addition to the items to be sold by each specialized machine, the online computer module can give access to an affiliated sales network by which the other products might also be networked.

In further examples, following steps can be followed for ordering products.

To order a portrait:

From an activity menu, choose: "Order a portrait";

Follow the prompts displayed on a display device to:

1. scanning a picture of a portrait's subject into a scanner connected to the kiosk;

2. choosing background, matting and frame materials of the portrait on a screen of a computer coupled to the kiosk;

3. choosing a size of the portrait; and 4. making payment by credit card or other payment methods.

To order furniture products:

1. choosing a design style;

2. paying a required amount of coins or other payment methods to pick wood quality and color/pattern; and 3. using the the computer coupled to the kiosk or go home using a home computer to order online to book and pay.

For assistance, the user can click a link to visit a customer assistance website. Having selected samples and styles, the customer can bring home the sample, along with a printout of the wish-listed items home. The printout can provide a link to the customer's wish list.

Alternatively, a digital data product, such as an inexpensive memory device can be dispensed from the kiosk, with wish-list information, to plug-into the home computer.

Alternatively, a link, to the customer's wish-list, can be emailed from the kiosk to the user's home computer.

If the customer buys at the kiosk, a receipt can be printed at the kiosk, and or emailed to the user customer.

For products comprising wood, samples having sizes with thickness of 1 mm×2"×2" wood blocks can be provided at the frontal surface (70) or dispense therefrom. Each wood block or fabric or paint swatch can have an identifier or sample's ID, such as bar code and ID coded such as P-Oll-zip-machine number-block number. The sample's ID can be used to locate where the kiosk is located, to identify the wood, its finish and color identification, such as a color number or color code.

A color number color bank with color numbers will be located online.

Paint manufactures can have their color palettes on the website for a user to use, to match fabrics to the color the user knows she has painted her wall with. A fabric manufacturer can put virtual fabric samples on line, to compare to paint, on a split window.

Color numbers and bar codes can include information such as:

country code, zip code, manufacture number, and color number.

In case the supply of take-home swatches or wood blocks run out at a kiosk, the interactive display can tell the user locations of other kiosks that have the products.

In even further examples, following steps can be followed to order various other products:

1. choosing a design style number;

2. paying a required amount of money by coins or other payment methods to pick wood quality and color/pattern;

3. using the computer coupled to the kiosk or using other computers to online book and pay.

At the Kiosk the customer can click a link for assistance. At home, for assistance, the customer can visit a website such as following:

www.ezp-store.com.

Wood samples or plastic laminate or tile samples can be at 1.1mm thick and 2"×2" squares. Swatches and wood samples can be dispensed on a roll of perforated adhesive paper by a stepping motor. The paper can include bar code, other scanable, or human-readable identifying information on its non-adhesive surface. The samples can also be dispensed for any of the aforementioned dispensing devices.

Various identifying systems can be used by the kiosk owner to identify each kiosk. Examples of the identification system can include a kiosk ID number, comprising a country code, such as a dialing code, such as 011 for USA; zip codes or postal codes where the machine is located; and a machine number.

When the Kiosk needs service or resupply, it will advise the franchiser, or advise the local distributor, who will know where this machine is, by its kiosk ID. Such advice may be transmitted by email, text message, instant message, fax, voice mail, or other means of electronic communication.

Traditional online marketing only have pictures and the pictures cann't showing quality and feel of products and can cause returns if a customer finally receives the product with poor quality. The kiosk system of this disclosure can supply physical samples of sales products in same material quality, color, patterns, or a combination thereof. Traditional physical stores typically have limited products to sell with limited space. The kiosks of this disclosure can increase the numbers of products to be displayed with certain display space.

Another advantage of the kiosk system of this disclosure can include making retail purchase real time. The order can be received in real time and products can be produced in factories/manufacturers in real time. Further, the product can be delivered direct from factories or manufacturers to a customer reducing overall costs such as warehouse of current traditional retail shipping. The system and process of this disclosure can particularly reduce costs for luxury products and customized products by directly ordering and customizing via the kiosk system.

What is claimed is:

1. A kiosk system comprising one or more kiosks for dispensing one or more target products, each of said kiosks comprising:

A1) a kiosk housing (200);

A2) a user interface system (201) comprising one or more input devices, one or more display devices, or a combination thereof; and A3) one or more dispensing systems (203) housed in said kiosk housing, each of said dispensing systems comprises one or more storage devices for storing a plurality of stored products, a dispensing control system for selecting said target products from said stored products and dispensing said target products based on a dispensing signal, wherein said dispensing control system comprises:

B1) at least one positioning drive device (208) to position a target storage device into a dispensing position based on said dispensing signal; and B2) at least one dispensing drive device (209) comprising a dispensing drive coupling (219) for coupling to one of the storage devices based on said dispensing signal;

said dispensing drive device (209) is positioned in a center space of a circular storage tower (221) formed by arranging said storage devices in a circular pattern on a storage base (213), said circular storage tower (221) having a rotational axis (222); and said dispensing drive device (209) is movable along a center track (215) by a driving rod (214), said center track (215) and said driving rod (214) being parallel to said rotational axis (222).

2. The kiosk system of claim 1, wherein said storage devices are movably positioned over the storage base (213) coupled to said positioning drive device.

3. The kiosk system of claim 2, wherein each of said storage devices comprises a linear dispensing-storage drive (218) for receiving one or more dispensing packages (217), said linear dispensing-storage drive (218) has a dispensing coupling (216) at one end and a releasing end (212) at the other end distal to said dispensing coupling (216), said dispensing coupling (216) is configured to be coupled to said dispensing drive coupling (219) for dispensing one of said dispensing packages from said releasing end (212) based on the dispensing signal at said dispensing position and is configured to be un-coupled to said dispensing drive coupling when said storage device is not at said dispensing position.

4. The kiosk system of claim 3 further comprising a database comprising product data, said product data comprise interrelated images of one or more sales products, motion images of said sale products, text descriptions of said sales products, identifiers of the sales products, or a combination thereof, said database is functionally coupled to each of said kiosks.

5. The kiosk system of claim 4, wherein said stored products comprise one or more said sales products, one or more parts of said sales products, one or more specimens of said sales products, one or more simulated specimens of said sales products, one or more image products of said sales products, one or more digital data products of said sales products, or a combination thereof.

6. The kiosk system of claim 5, each of said kiosks further comprises:

A4) a payment processing device (300) for receiving payments and generating said dispensing signal; said dispensing signal is generated based on a selection input for selecting said one or more target products and a payment approval signal.

7. The kiosk system of claim 6, wherein said selection input is based on images of said sales products, motion images of said sales products, text descriptions of said sales products, identifiers of said sales products, or a combination thereof, displayed on said one or more display devices.

8. The kiosk system of claim 7, wherein each of said kiosks further comprises:

A5) a computing device coupled to said one or more input devices and said one or more display devices, said computing device is functionally coupled to a computing program product comprising computing program codes for:

C1) receiving a request input from said one or more input devices;

C2) displaying product display data on said one or more display devices, said product display data are retrieved from said database and comprise images of one or more of said sales products, motion images of one or more of said sales products, descriptions of one or more of said sales products, identifiers of one or more of said sales products, or a combination thereof, based on said request input or a predetermined product display scheme;

C3) optionally, receiving one or more modified request inputs and repeating the steps C1)-C3); and C4) receiving the selection input from said one or more input devices selecting said one or more target products from said sales products.

9. The kiosk system of claim 8, wherein said computing program product further comprises computing program codes for:

C5) generating a product availability data based on said selection input and availability of one or more of said stored products associated to said one or more target products, said availability data comprise product location data and product quantity data of said plurality of stored products;

C6) displaying said product availability data on said display devices; and

C7) generating an order data for ordering said at least one of said target products if at least one of said target products is not available from said kiosk system, said order data comprise a target identifier of said at least one of said target products based on an order selection.

10. The kiosk system of claim 8, wherein said computing program product further comprises computing program codes for:

C8) generating a payment request based on said selection input and the payment schedule;

C9) displaying said payment request on said one or more display devices;

C10) generating said payment approval signal after receiving and verifying payments according to said payment request;

C11) generating said dispensing signal; and

C12) outputting said dispensing signal to said one or more dispensing systems where said one or more target products are stored to dispense said one or more target products.

11. The kiosk system of claim 1, wherein each of said kiosk further comprises a dispensing opening (210) positioned on said kiosk housing (200) for dispensing said target products, one or more subsequent display devices for displaying product information based on predetermined schedule, the selection input, history of selection inputs, a display input, one or more physical display structures, one or more testing spaces, one or more designing spaces, or a combination thereof.

12. The kiosk system of claim 1, wherein at least one of the kiosks comprises one or more functionally coupled modules selected from a display module, a dispensing module, a user interface module, or a combination thereof.

13. The kiosk system of claim 1, wherein at least one of said kiosks comprises a security system.

14. The kiosk system of claim 13, wherein said security system comprises a security connection to a remote security control device via wired connections, wireless connections, or a combination thereof, for monitoring, controlling and protecting said kiosk.

15. The kiosk system of claim 1 further comprising a host computing device functionally coupled to each of said kiosks via wired connections, wireless connections, or a combination thereof.

16. The kiosk system of claim 15, wherein said kiosk system comprises two or more said kiosks connected via wired connections, wireless connection, or a combination thereof.

17. A process for dispensing one or more target products, said process comprising the steps of:

P1) providing at least one kiosk;

P2) obtaining a request input from said one or more input devices;

P3) displaying product display data said on one or more display devices, said product display data comprise images of one or more of sales products, motion images of one or more of said sales products, descriptions of one or more of said sales products, identifiers of one or more of said sales products, or a combination thereof, based on said request input or a predetermined product display scheme;

P4) optionally, receiving one or more modified request inputs and repeating the steps P2-P4);

P5) obtaining a selection input from said one or more input devices to select one or more target products or one or more selected sales products; and P6) generating a product availability data based on said selection input and availability of one or more of said stored products associated to said one or more target products, and availability of said selected sales products, said availability data comprise product location data and product quantity data of said plurality of stored products, said selected sales products, or a combination thereof;

wherein said stored products comprise one or more said sales products, one or more parts of said sales products, one or more specimens of said sales products, one or more simulated specimens of said sales products, one or more image products of said sales products, one or more digital data products of said sales products, or a combination thereof; and wherein said kiosk comprises:

A1) a kiosk housing (200;

A2) a user interface system (201) comprising one or more input devices, one or more display devices, or a combination thereof; and A3) one or more dispensing systems (203) housed in said kiosk housing, each of said dispensing systems comprises one or more storage devices for storing a plurality of stored products, a dispensing control system for selecting said target products from said stored products and dispensing said target products based on a dispensing signal, wherein said dispensing control system comprises:

B1) at least one positioning drive device (208) to position a target storage device into a dispensing position based on said dispensing signal; and B2) at least one dispensing drive device (209) comprising a dispensing drive coupling (219) for coupling to one of the storage devices based on said dispensing signal;

said dispensing drive device (209) is positioned in a center space of a circular storage tower (221) formed by arranging said storage devices in a circular pattern on a storage base (213), said circular storage tower (221) having a rotational axis (222); and said dispensing drive device (209) is movable along a center track (215) by a driving rod (214), said center track (215) and said driving rod (214) being parallel to said rotational axis (222).

18. The process of claim 17 further comprising the steps of:

P7) generating a payment request based on said selection input and a payment schedule;

P8) displaying said payment request on said one or more display devices;

P9) generating a payment approval signal after receiving and verifying payments based on said payment request;

P10) generating a dispensing signal; and

P11) dispensing based on said dispensing signal said one or more target products from said one or more dispensing systems according to said product availability data.

19. The process of claim 17 further comprising the steps of:

P12) displaying said product availability data on said display devices; and

P13) generating an order data for ordering said at least one of said target products or said selected sales products, said order data comprise a target identifier of at least one of said target products or sale product identifiers of said selected sales products based on an order selection.

* * * * *